US009392880B2

(12) United States Patent
Do

(10) Patent No.: US 9,392,880 B2
(45) Date of Patent: Jul. 19, 2016

(54) COLLAPSIBLE CRIB

(71) Applicant: Liem Do, Vancouver, WA (US)

(72) Inventor: Liem Do, Vancouver, WA (US)

( * ) Notice: Subject to any disclaimer, the term of this patent is extended or adjusted under 35 U.S.C. 154(b) by 454 days.

(21) Appl. No.: 14/075,671

(22) Filed: Nov. 8, 2013

(65) Prior Publication Data

US 2014/0208504 A1 Jul. 31, 2014

Related U.S. Application Data

(60) Provisional application No. 61/758,162, filed on Jan. 29, 2013.

(51) Int. Cl.

| | |
|---|---|
| ***A47D 7/00*** | (2006.01) |
| ***A47C 7/00*** | (2006.01) |
| ***A47D 15/00*** | (2006.01) |

(52) U.S. Cl.

CPC ..... *A47D 7/002* (2013.01); *A47D 15/00* (2013.01); *A47D 7/00* (2013.01)

(58) Field of Classification Search

CPC ..... A47D 7/00; A47D 7/02; A47D 9/00; A47D 9/005; A47D 15/00

USPC ..... 5/416

See application file for complete search history.

(56) References Cited

U.S. PATENT DOCUMENTS

| | | | | |
|---|---|---|---|---|
| 5,517,707 | A * | 5/1996 | LaMantia | A47C 29/003 135/96 |
| 2004/0099301 | A1* | 5/2004 | Zhang | A47C 29/006 135/135 |
| 2005/0045221 | A1* | 3/2005 | Forshpan | A47D 15/00 135/135 |
| 2011/0048481 | A1* | 3/2011 | Morris | A47C 29/003 135/96 |
| 2012/0063702 | A1* | 3/2012 | Daugherty | A47D 9/005 383/4 |
| 2012/0117726 | A1* | 5/2012 | LaMantia | A47C 29/003 5/97 |
| 2013/0291918 | A1* | 11/2013 | Lovell | A47C 29/003 135/151 |
| 2014/0208505 | A1* | 7/2014 | Burkholder | A47D 13/063 5/99.1 |
| 2014/0224578 | A1* | 8/2014 | Blankenship | A47D 15/00 181/290 |

* cited by examiner

*Primary Examiner* — David E Sosnowski

(57) ABSTRACT

A collapsible crib is an infant bed that is particularly sized in order to facilitate transport and incorporates various features that permit it to be deployed and assembled with relative ease. The collapsible crib contains a canopy section and a crib section that are utilized to provide a partially enclosed sleeping area for an infant. The canopy section is detachably coupled to the crib section and provides shade to the interior portion where the infant would be positioned. The crib section is the padded enclosed sleeping area that is particularly constructed with features permitting it to be disassembled and reassembled with ease. The canopy section and the crib section contain features that permit them to transition between a collapsed state and an assembled state. Through the combination of these components the collapsible crib offers a safe and secure enclosed sleeping area for infants that can be easily transported.

16 Claims, 13 Drawing Sheets

COLLAPSIBLE CRIB

The current application claims a priority to the U.S. Provisional Patent application Ser. No. 61/758,162 filed on Jan. 29, 2013.

FIELD OF THE INVENTION

The present invention relates generally to a crib or infant bed, more specifically to a collapsible crib designed with specific features that permit it to be quickly deployed from a collapsed state to an assembled state within seconds.

BACKGROUND OF THE INVENTION

Infant beds provide a safe enclosed sleeping area for an infant. Normally, an infant is transferred to an infant bed once they reach a certain age or outgrow their bassinet. At this age, infants begin to develop motor skills for rolling over and sitting up. Infant beds offer several benefits over bassinets since they provide a lower center of gravity, a broader base, and the ability to hold a larger infant than a bassinet. The larger size provides ample room for the infant to move around while the broader base and lower center of gravity prevents the infant bed from tipping over as the infant learns to roll over and sit up. Although infant beds offer clear benefits over bassinets, they are difficult to transport and assemble.

Unlike bassinets, infant beds are sturdier in construction and as a result are larger in size and particularly shaped in order to prevent them from tipping over. While the principal benefit of an infant bed is to offer a safe and secure enclosed sleeping area for the infant, their construction makes them difficult to transport when assembled. Due to this limitation, many parents forego bringing an infant bed with them when they travel and may improvise an infant bed that lacks the safety associated with a dedicated infant bed. Although some infant beds have been constructed with specific features that enable them to be disassembled and reassembled for facilitated transport, many of these infant bed are still too large to be carried by a single parents and often require the assistance when being reassembled.

It is therefore the object of the present invention to provide a collapsible crib that is particularly sized in order to facilitate transport and incorporates various features that permit it to be deployed and assembled with relative ease. The present invention comprises a canopy section and a crib section that are utilized in conjunction to provide a partially enclosed sleeping area for an infant. The canopy section is detachably coupled to the crib section and provides shade to the interior portion of the crib section where the infant would be positioned. The crib section is the padded enclosed sleeping area that is particularly constructed with features permitting it to be disassembled and reassembled with ease. The canopy section and the crib section contain features that permit them to transition between a collapsed state and an assembled state. Through the combination of these components the collapsible crib can be easily transported between locations to offer parents with a safe and secure enclosed sleeping area for their infant.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
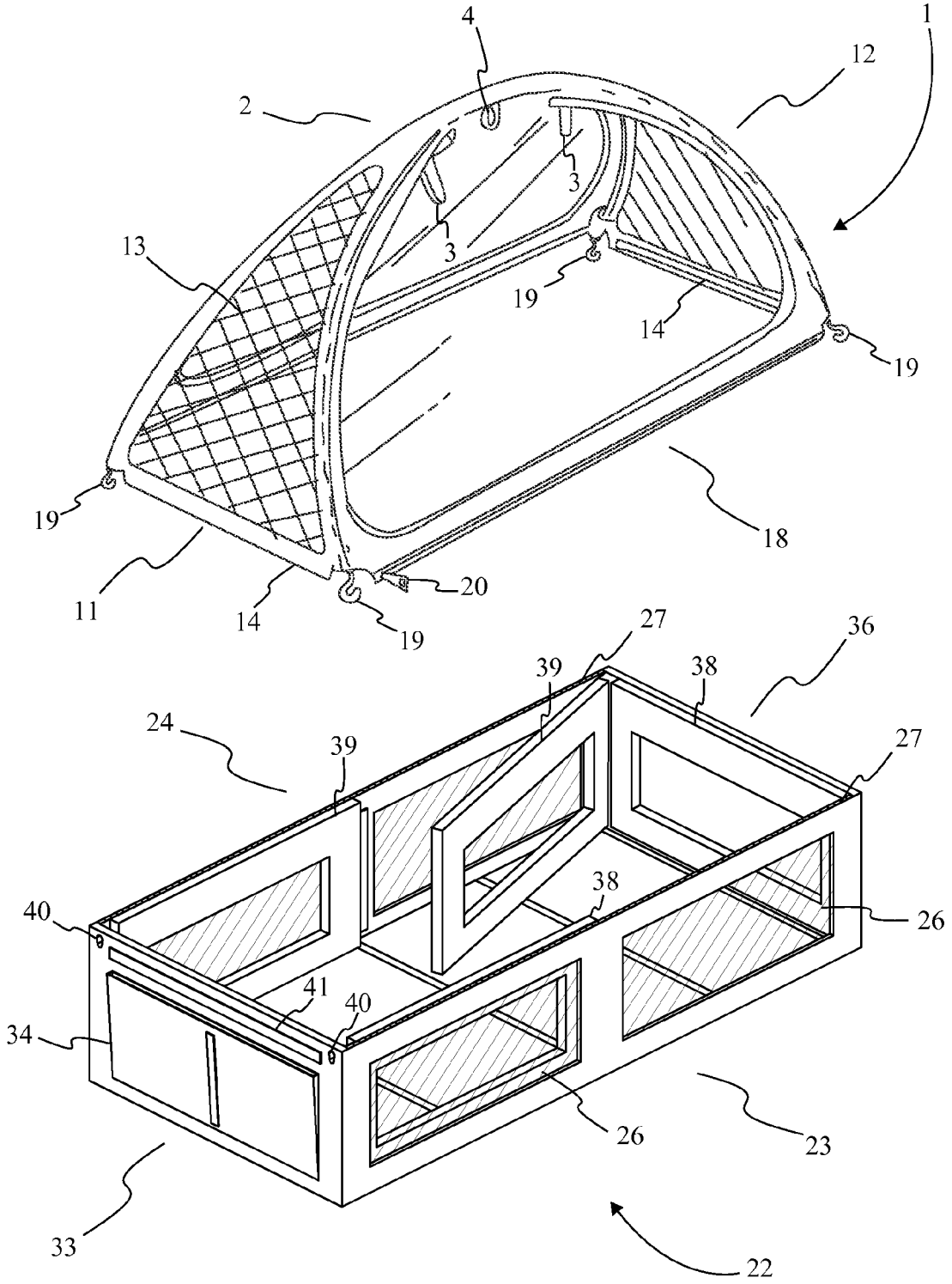
FIG. 1 is a perspective view displaying the canopy section and the crib section in the assembled state, as per the current embodiment of the present invention.
Figure 12:
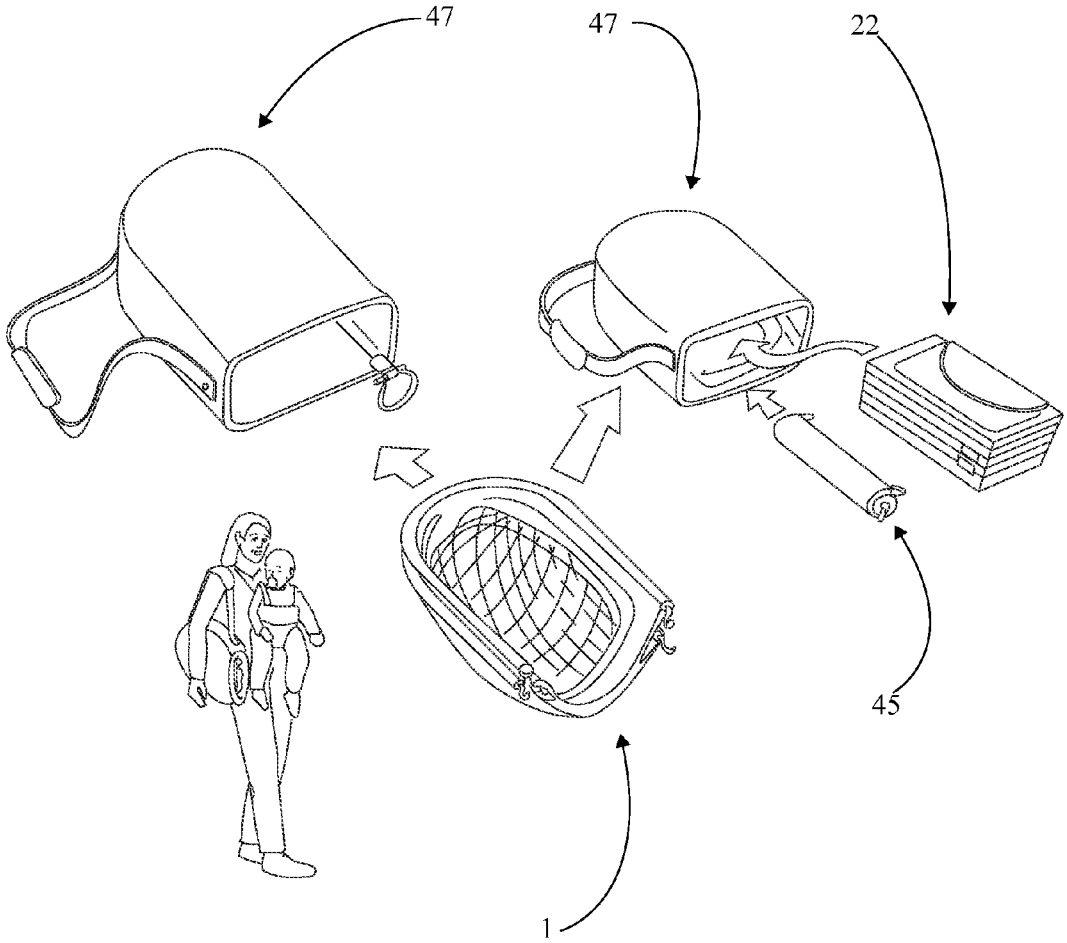
FIG. 12 is an image displaying the canopy section, the crib section, and the floor pad in the collapsed state being arranged into a storage bag as per an embodiment of the present invention.
Figure 13:
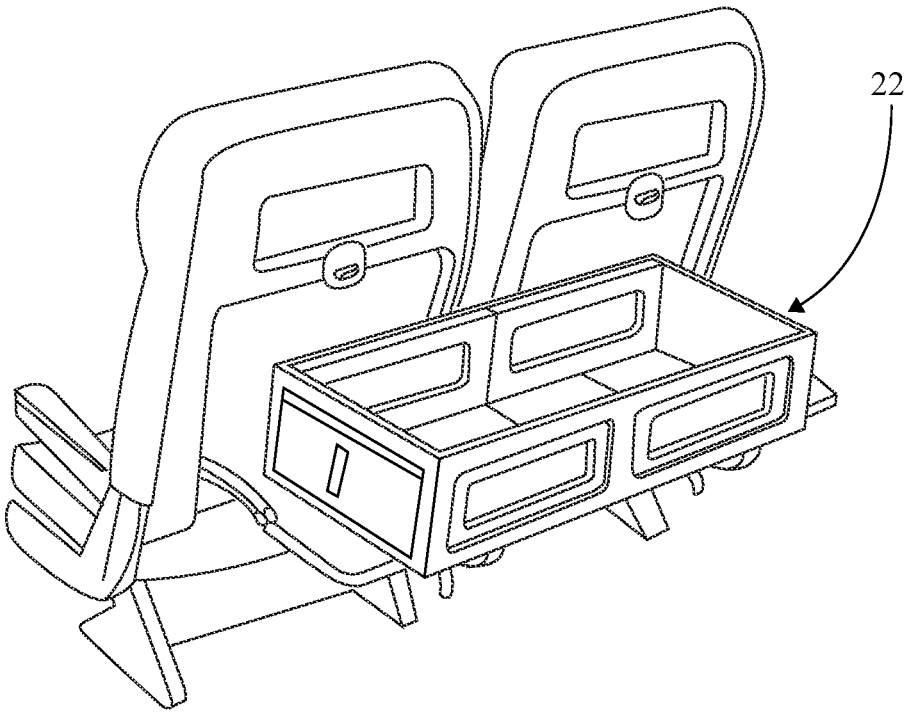
FIG. 13 is an image displaying the crib section in the assembled state deployed on top of a set of air line trays as per an embodiment of the present invention.

Referencing FIG. 1 and FIG. 12, the present invention is a collapsible crib that incorporates features in its construction that allow it function in two operative states, a collapsed state and an assembled state. The collapsed state allows for facilitated transport of the collapsible crib when not in use and the assembled state allows for the collapsible crib to function as an infant bed capable of holding a child that would be too large for a bassinet. The transition between the collapsed state and the assembled state requires minimal effort in both directions allowing the collapsible crib to be deployed for use within a few seconds. In the current embodiment of the present invention, the collapsible crib comprises a canopy section 1 and a crib section 22. The canopy section 1 is used to provide shade to the crib section 22 but additionally functions as a means of hanging decorations that help stimulate an infant. The crib section 22 functions as an infant bed that contains both flexible and rigid portions that allow it to enter the collapsed state and the assembled state. The canopy section 1 and the crib section 22 are provided with complementary engagements that enable the canopy section 1 to be securely coupled to the crib section 22 during the assembled state and be quickly detached and stored for the collapsed state. In the collapsed state the canopy section 1 and the crib section 22 can be stored within a storage bag 47 specifically permitting facilitated transportation of the collapsible crib.

Figure 9:
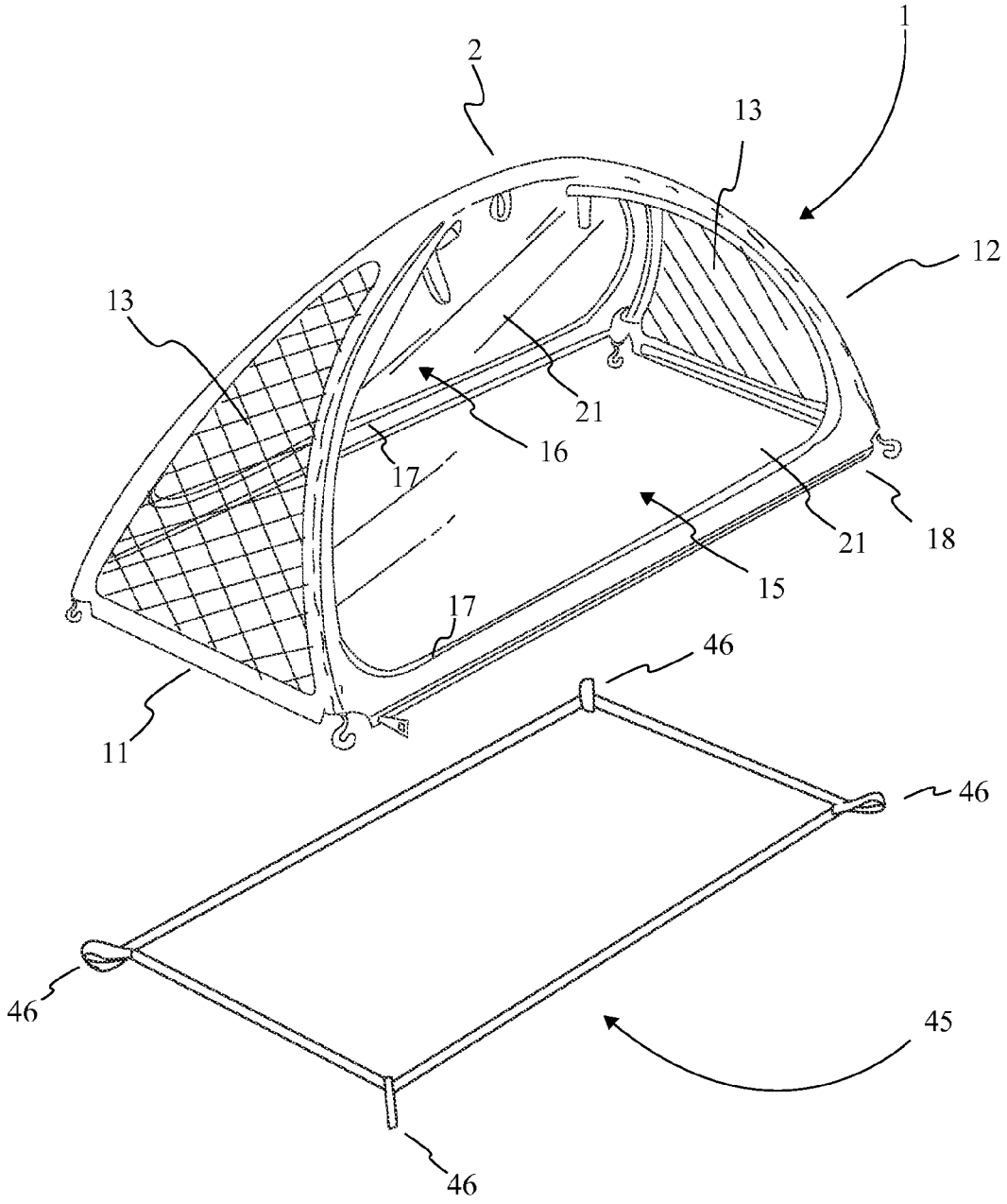
FIG. 9 is a perspective view displaying the canopy section being aligned for use with in a floor pad.
Figure 10:
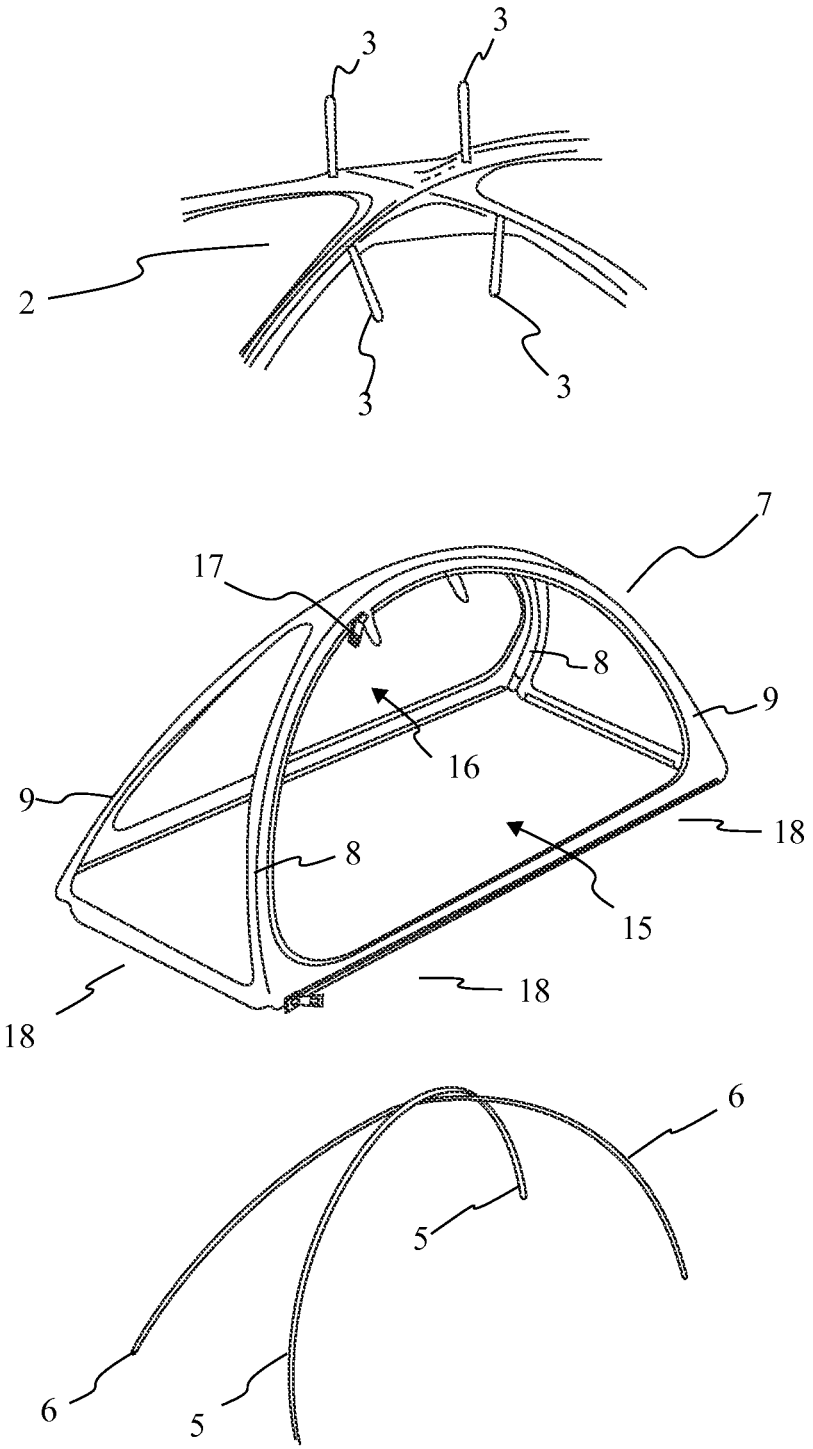
FIG. 10 is an enhanced view displaying the canopy cover, the apex, and the flexible poles and their relative positioning as per the current embodiment of the present invention.
Figure 11:
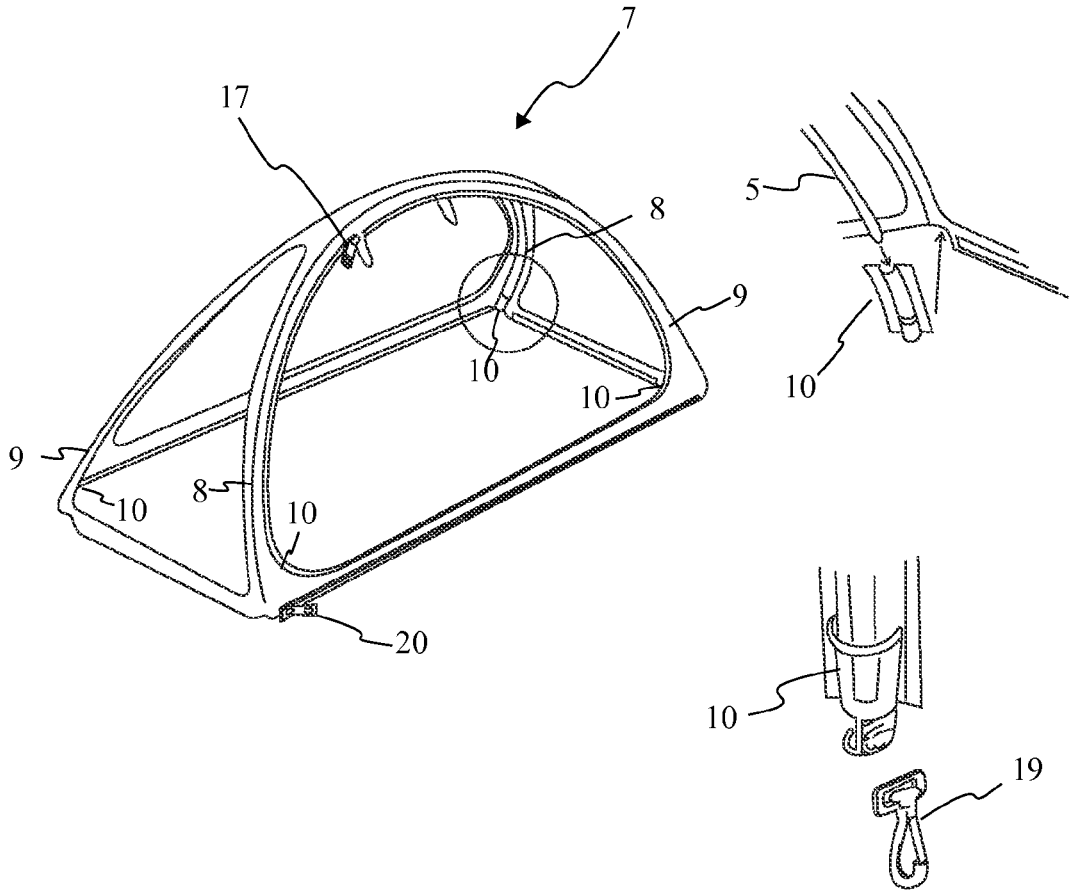
FIG. 11 is an enhanced view displaying the engagement between the flexible poles and the canopy cover as per the current embodiment of the present invention.

Referencing FIG. 9-11, the canopy section 1 is a collapsible component that provides shade and protection to the crib section 22. The canopy section 1 is detachable coupled to the crib section 22. In the current embodiment of the present invention, the canopy section 1 comprises an apex 2, a first flexible pole 5, a second flexible pole 6, a canopy cover 7, at least one canopy door 21. The first flexible pole 5 and the second flexible pole 6 are integrally positioned structural elements that provide the canopy section 1 with its particular shape and enable it to transition from the assembled state to the collapsed state. The apex 2 is positioned adjacent to the intersection of the first flexible pole 5 and the second flexible pole 6. During the assembled state the apex 2 is the most elevated portion of the canopy section 1. The canopy cover 7 is the provided as the overlaid material that is given shape by the first flexible pole 5 and the second flexible pole 6. The canopy cover 7 functions as the most visible portion of the canopy section 1 that provides shade to the crib section 22. The at least one canopy door 21 is provided as a detachable means of fully enclosing the crib section 22.

Referencing FIG. 9-11, in the current embodiment of the present invention, the first flexible pole 5 is found parabolically flexed across the second flexible pole 6, wherein the second flexible pole 6 is parabolically flexed below the first flexible pole 5. Both the first flexible pole 5 and the second flexible pole 6 are flexed in into a parabolic curvature in order to utilize the elasticity of their construction to provide additional rigidity to the canopy section 1 in the assembled state. The canopy cover 7 is found disposed over the first flexible pole 5 and the second flexible pole 6, wherein the first flexible pole 5 and the second flexible pole 6 give the canopy cover 7 its shape. The canopy cover 7 is particularly formed to resist the elasticity of the first flexible pole 5 and the second flexible pole 6 resulting in the semi rigid construction of the canopy section 1. The apex 2 is found positioned coincident near the intersection of the first flexible pole 5 and the second flexible pole 6, providing the apex 2 as the tallest portion of the canopy section 1 when in the assembled state.

Referencing FIG. 1 and FIG. 9-11, the canopy cover 7 is disposed on top of the first flexible pole 5 and the second flexible pole 6. The disposed positioning provides the canopy cover 7 with a particular formed shaped that is semi rigid due to the elasticity of the first flexible pole 5 and the second flexible pole 6. In the current embodiment of the present invention, the canopy cover 7 comprises a first pole guide 8, a second pole guide 9, a front section 11, a rear section 12, a first canopy opening 15, a second canopy opening 16, and a canopy base section 18. The first pole guide 8 and the second pole guide 9 function as engagement points for the first flexible pole 5 and the second flexible pole 6, respectively. The front section 11 and the rear section 12 are subsections of the canopy cover 7 that oppositely positioned to each other. The first canopy opening 15 and the second canopy opening 16 correspond to subsections of the canopy cover 7 that permit the canopy cover 7 to function as a full enclosure or a partial enclosure when coupled to the crib section 22.

Referencing FIG. 1 and FIG. 9-11, the first pole guide 8 and the second pole guide 9 are traversed by the first flexible pole 5 and the second flexible pole 6, respectively. The first pole guide 8 and the second pole guide 9 are particularly positioned to flex the first flexible pole 5 and the second flexible pole 6 into a particular shape that is elastically retained by the flexible properties of the first flexible pole 5 and the second flexible pole 6. In order to retain the first flexible pole 5 and the second flexible pole 6 in position, both the first pole guide 8 and the second pole guide 9 comprise a pair of pole mounts 10. The pair of pole mounts 10 are coincident with the terminal openings of both the first pole guide 8 and the second pole guide 9. The first flexible pole 5 is terminally engaged to the pair of pole mounts 10 of the first pole guide 8, similarly the second flexible pole 6 is terminally engaged to the pair of pole mounts 10 of the second pole guide 9. The pair of pole mounts 10 are found positioned coincident with the canopy base section 18.

Referencing FIG. 1 and FIG. 8-11, the front section 11 and the rear section 12 are subsections of the canopy cover 7 that are formed by the positioning of the first flexible pole 5 and the second flexible pole 6. In the current embodiment of the present invention the front section 11 and the rear section 12 each comprise a light mesh screen 13 and a panel coupler 14. The light mesh screen 13 is provided as a portion of the front section 11 and the rear section 12 that is mostly transparent and allows airflow through the canopy cover 7. The light mesh screen 13 is found positioned between the panel coupler 14 and the apex 2. The panel coupler 14 is provided as a means of securing the front section 11 and the rear section 12 to portions of the crib section 22. The panel coupler 14 is found positioned coincident with portions of the canopy base section 18.

Referencing FIG. 1 and FIG. 8-11, the first canopy opening 15 and the second canopy opening 16 are provided as oppositely positioned regions of the canopy cover 7 that are engageable with the at least one canopy door 21. The first canopy opening 15 and the second canopy opening 16 are subsection of the canopy cover 7 that are formed by the positioning of the first flexible pole 5 and the second flexible pole 6. The first canopy opening 15 is found positioned between the apex 2 and the canopy base section 18. The second canopy opening 16 is found positioned between the apex 2 and the canopy base section 18, opposite the first canopy opening 15. In the current embodiment of the present invention, the first canopy opening 15 and the second canopy opening 16 each comprise a canopy door fastener 17. The canopy door fastener 17 is provided as the detachable engagement that secures the at least one canopy door 21 to either the first canopy opening 15 or the second canopy opening 16. it should be noted that while the canopy door fastener 17 is show being peripherally positioned around the first canopy opening 15 and the second canopy opening 16, that the canopy door fastener 17 may be positioned in any means that permits it to detachably engaging the at least one canopy door 21.

Referencing FIG. 1 and FIG. 8-11, the canopy base section 18 is the lower portion of the canopy cover 7 that is coincident with components of the first pole guide 8, the second pole guide 9, the front section 11, the rear section 12, the first canopy opening 15, and the second canopy opening 16. The canopy base section 18 is provided with a particular shape that is complementary to the crib section 22. In the current embodiment of the present invention, the canopy base section 18 comprises a plurality of canopy anchors 19 and lateral section fasteners 20. The plurality of canopy anchors 19 function as a versatile connection means of securing the canopy section 1 to a complimentary engagement on the crib section 22 or a floor pad 45. Each of the canopy fasteners of the plurality of canopy fasteners are found positioned adjacent to a pole mount of the pair of pole mounts 10. The lateral section fasteners 20 are engageable regions of the base section that are positioned below the first canopy opening 15 and the second canopy opening 16. A lateral section fastener 20 is found positioned between the first canopy opening 15 and the crib section 22. Another lateral section fastener 20 is found positioned between the second canopy opening 16 and the crib section 22. The lateral section fasteners 20 can be provided as any means of securing the canopy base section 18 to the crib section 22.

Referencing FIG. 1 and FIG. 8-11, the apex 2 is the region of the canopy base section 18 that is positioned coincident with the point of intersection of the first flexible pole 5 and the second flexible pole 6. The apex 2 is the furthest point from the crib section 22 during the assembled state. In the current embodiment of the present invention the apex 2 comprises a pair of canopy door ties 3 and a hanger loop 4. The pair of canopy door ties 3 function as a temporary means of storing the at least one canopy door 21 when it is uncoupled to either the first canopy opening 15 or the second canopy opening 16. When uncoupled, the at least one canopy door 21 is rolled up at is temporarily secured near the apex 2 by way of the pair of canopy door ties 3. It should be noted that the pair of canopy door ties 3 are found coincident with both the first canopy opening 15 and the second canopy opening 16. The hanger loop 4 is provided as an attachment point for infant decorations such as a mobile. The hanger loop 4 is found positioned below the intersection of the first flexible pole 5 and the second flexible pole 6. The hanger loop 4 may be constructed of a rigid or flexible material provided the construction does not interfere with the function of the canopy section 1.

Figure 2:
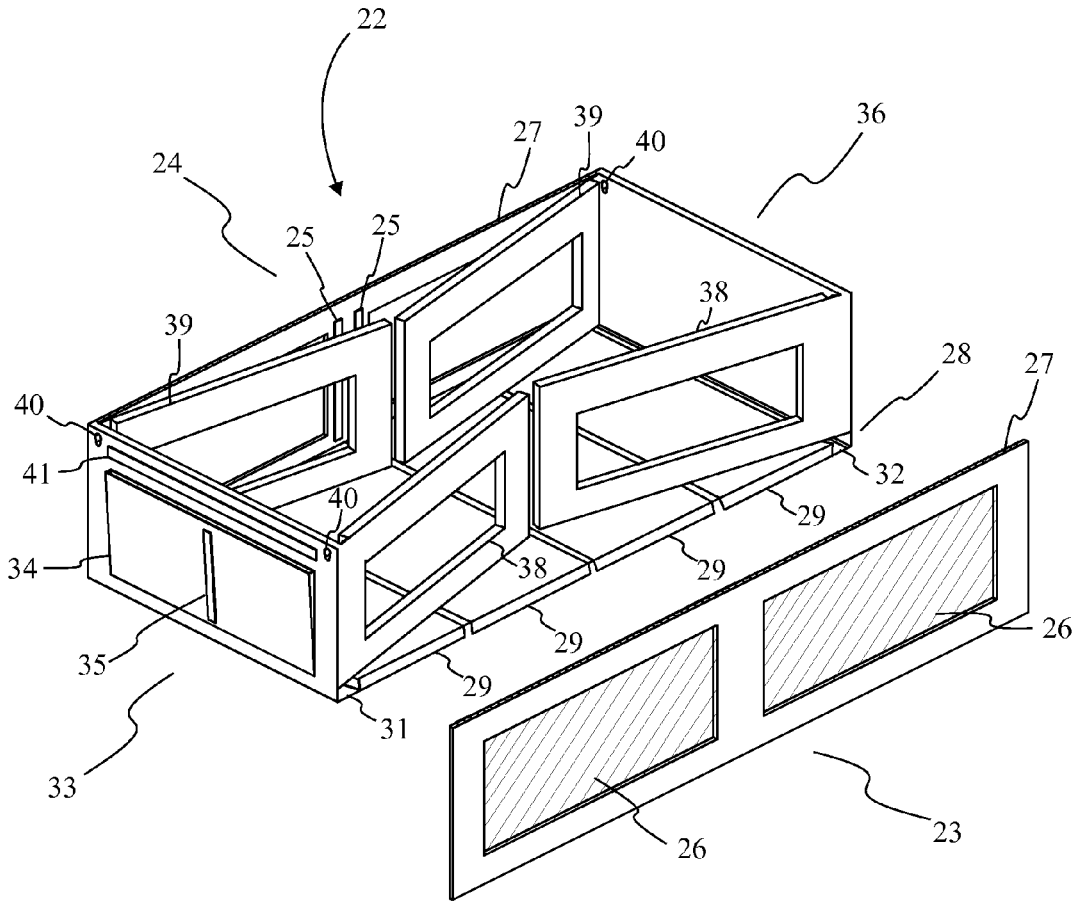
FIG. 2 is an expanded perspective view displaying the folding panels associated with the front panel and the rear panel of the crib section, as per the current embodiment of the present invention.
Figure 3:
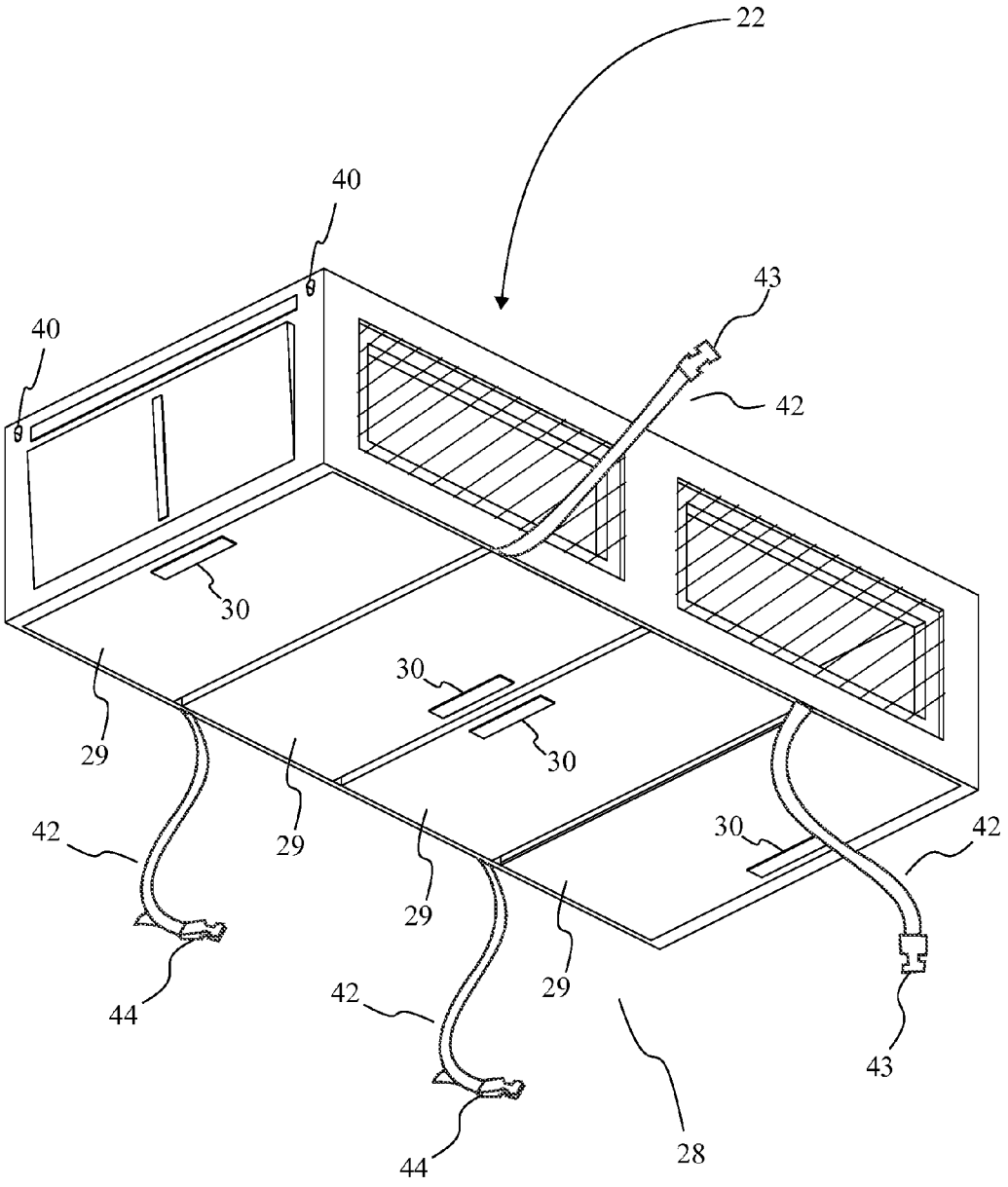
FIG. 3 is a bottom perspective view displaying the lower section of the crib section in the assembled state as per the current embodiment of the present invention.
Figure 4:
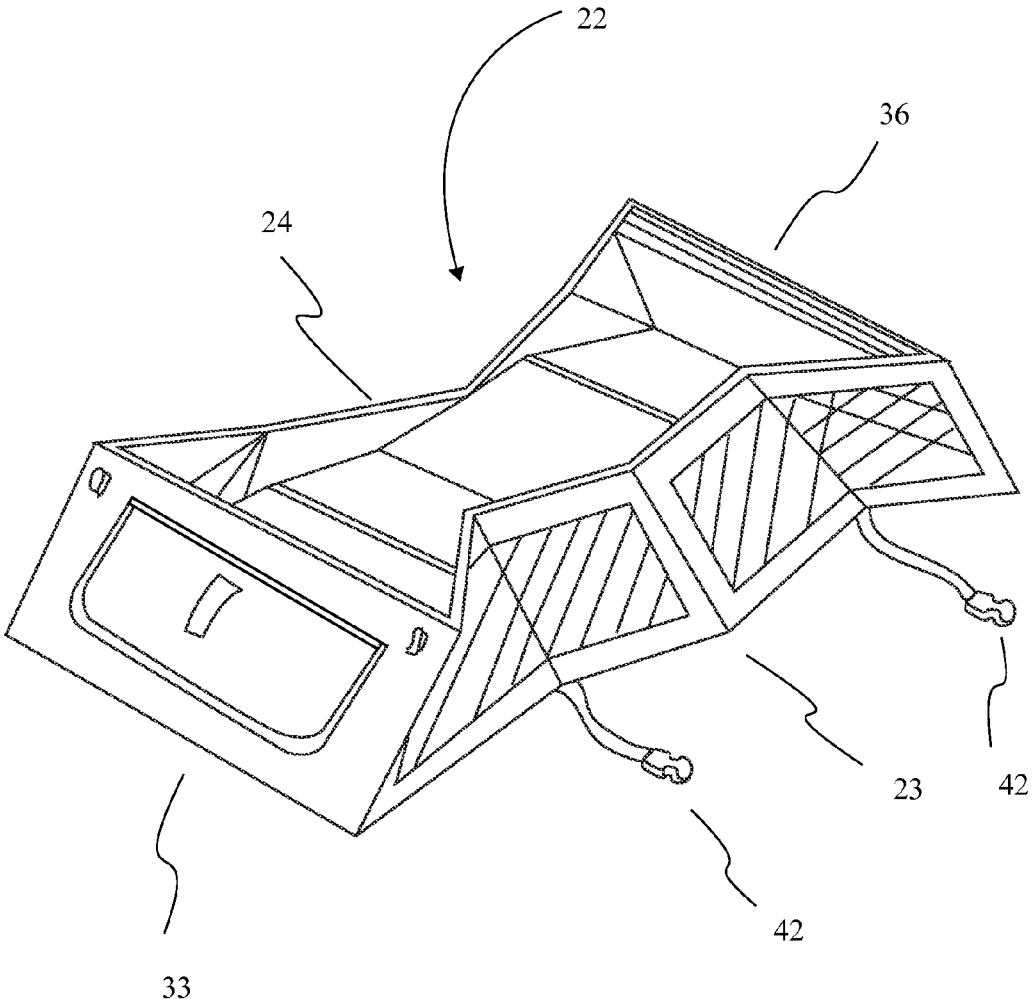
FIG. 4 is a perspective view displaying the crib section transitioning between the assembled state and the collapsed state as per the current embodiment of the present invention.

Referencing FIG. 1-3, the crib section 22 provides a protective enclosure for an infant. The crib section 22 contains various design features that enable it to transition between the assembled state and the collapsed state. The crib section 22 is detachably coupled to the canopy section 1 through various detachable engagements. in the current embodiment of the present invention the crib section 22 comprises a first lateral section 23, a second lateral section 24, a lower section 28, a front panel 33, a rear panel 36, and at least one adjustable strap 42. The first lateral section 23 and the second lateral section 24 are provided as oppositely positioned regions of the crib section 22 that form an enclosure with the front panel 33 and the rear panel 36. The first lateral section 23 and the second lateral section 24 are flexible in construction and permit the collapsible crib to transition between the collapsed state and the assembled state. The first lateral section 23 is found positioned opposite the second lateral section 24. The front panel 33 and the rear panel 36 provide with the crib section 22 with structural support during the assembled state. The front panel 33 and the rear panel 36 are rigid panel sections positioned opposite one another across the crib section 22. The lower section 28 is the padded lower portion of the crib section 22 that holds an infant when they are placed into the crib section 22. The lower section 28 is collapsible in design and is fully extended during the assembled state and compacted during the collapsed state. The lower section 28 is positioned opposite the detachable engagement of the canopy section 1 with the crib section 22. The lower section 28 is found bordered by the first lateral section 23, the second lateral section 24, the front section 11, and the rear panel 36. The at least one adjustable strap 42 functions as a means of securing the crib section 22 to various surfaces such as a folding tray on an airplane. The at least one adjustable strap 42 is found coupled to the lower section 28.

Referencing FIG. 2-5, the first lateral section 23 and the second lateral section 24 are positioned opposite each other across the crib section 22. The first lateral section 23 is found detachably coupled to the lateral section fasteners 20 adjacent the first canopy opening 15. The second lateral section 24 is found detachably coupled to the lateral section fasteners 20 adjacent the second canopy opening 16. Both the first lateral section 23 and the second lateral section 24 are provided with a flexible construction that permits them to collapse or expand between the front panel 33 and the rear panel 36 when transitioning between the collapsed state and the assembled state. In the current embodiment of the present invention the first lateral section 23 and the second lateral section 24 each comprise a pair of panel fasteners 25, a heavy mesh screen 26, and a canopy base fastener 27.

Referencing FIG. 1-5, the pair of panel fasteners 25 on the first lateral section 23 are provided as a means of detachably securing components of the front panel 33 and the rear panel 36 to the first lateral section 23. Similarly the pair of panel fasteners 25 of the second lateral section 24 are provided as a means of detachably securing components of the front panel 33 and the rear panel 36 to the second lateral section 24. The pair of panel fasteners 25 are found positioned on the interior side of both the first lateral section 23 and the second lateral section 24. It should be noted that the pair of panel fasteners 25 can be provided as any fastener method that permits the necessary engagements between the components of the front panel 33 and the rear panel 36 with the first lateral section 23 and the second lateral section 24.

Referencing FIG. 1-3 and FIG. 5-7, the heavy mesh screen 26 is provided as a semi transparent material that permits air flow but is strong enough to prevent penetration. The heavy mesh screen 26 allows for line of sight through the first lateral section 23 and the second lateral section 24. The heavy mesh screen 26 is provided with sufficient flexibility that it does not interfere with the transition of the first lateral section 23 and the second lateral section 24 between the collapsed state and the assembled state. The heavy mesh screen 26 of the first lateral section 23 and the second lateral section 24 are found positioned between the canopy base fasteners 27 and the lower section 28.

Referencing FIG. 1-3 and FIG. 5-7, the canopy base fasteners 27 function as one of the engagement means of securing the canopy section 1 to the crib section 22. The canopy base fasteners 27 are positioned coincident with the lateral section fasteners 20 of the canopy base section 18. The canopy base fastener 27 of the first lateral section 23 are positioned between the heavy mesh screen 26 of the first lateral section 23 and the first canopy opening 15. The canopy base fasteners 27 of the second lateral section 24 are found positioned between the heavy mesh screen 26 of the second lateral section 24 and the second canopy opening 16. The canopy base fasteners 27 are complementary components to the lateral section fasteners 20. It should be noted that the canopy base fasteners 27 are provided as any fastening means that can securely couple the canopy section 1 to the crib section 22 without interfering with the transition between the collapsed state and the assembled state.

Referencing FIG. 1-3 and FIG. 5-7, the front panel 33 and the rear panel 36 provide structural support to the crib section 22. The front panel 33 and the rear panel 36 provide the first lateral section 23 and the second lateral section 24 with a rigid shape in the assembled state. The front panel 33 is detachably coupled to the front section 11. The rear panel 36 is detachably coupled to the rear section 12. In the current embodiment of the present invention, the front panel 33 and the rear panel 36 each comprise a first folding panel 38, a second folding panel 39, a pair of anchor mounts 40, and a canopy coupler 41. The first folding panel 38 and the second folding panel 39 are rigid components that pivot into position with the first lateral section 23 and the second lateral section 24 providing structural support during the assembled configuration. The pair of anchor mounts 40 function as complementary engagements that permit the plurality of canopy anchors 19 to detachably engage the crib section 22. The canopy coupler 41*s* are provided as an additional engagement means between the front panel 33 and the rear panel 36 with the corresponding front section 11 and rear section 12. it should be noted that while the canopy couplers 41 and the pair of anchor mounts 40 function as complementary attachments, the pair of anchor mounts 40 provide a structural engagement between the crib section 22 and the canopy section 1, while the canopy coupler 41 provides a means of tightening the canopy cover 7 material across that spans between the front panel 33 and the rear panel 36.

Figure 5:
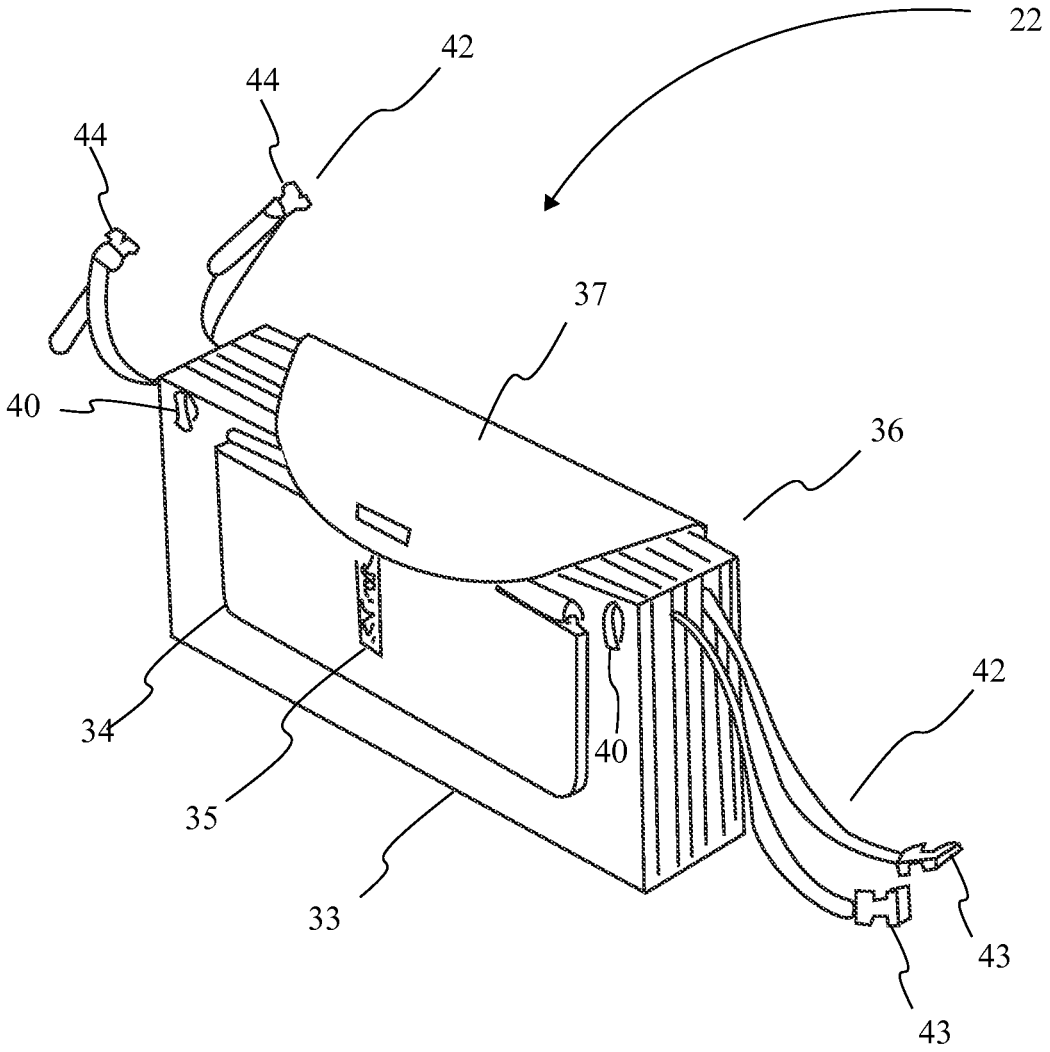
FIG. 5 is a perspective view displaying the crib section in the collapsed state as per the current embodiment of the present invention.

Referencing FIG. 1 and FIG. 5, the first folding panel 38 and the second folding panel 39 are provided as structural components that provide rigidity to the first lateral section 23 and the second lateral section 24 during the assembled state. the first folding panel 38 and the second folding panel 39 pivot into position with the first lateral section 23 and the second lateral section 24, respectively, wherein the first folding panel 38 of the front panel 33 and the rear panel 36 pivots into position with the first lateral section 23, while the second folding panel 39 of the front panel 33 and the rear panel 36 pivots into position with the second lateral section 24. When the crib section 22 transition from the assembled state to the collapsed state the first folding panel 38 and the second folding panel 39 detach from their engagement with the first lateral section 23 and the second lateral section 24 respectively and pivot into a parallel alignment with their respective panel, wherein the respective panel is either the front panel 33 or the rear panel 36. Additionally the first folding panel 38 and the second folding panel 39 each comprise a viewing area that is centrally positioned. The viewing area is provided as a means of permitting the line of sight through both the first folding panel 38 and the second folding panel 39 when coincident with the heavy mesh screen 26 of the first lateral section 23 and the second lateral section 24. The first folding panel 38 and the second folding panel 39 are secured to the first lateral section 23 and the second lateral section 24 by way of the pair of folding panel fasteners. The engagement between the first folding panel 38 and the second folding panel 39 with the pair of folding panel fasteners is sufficiently secure to prevent unwanted detachment.

Referencing FIG. 1-3 and FIG. 5-7, the rear panel 36 comprises a flap 37. The flap 37 is provided as a coupler that secures the rear panel 36 and the front panel 33 in close proximity to one another in the collapsed state. The flap 37 is utilized as a retaining member that joins the front panel 33 and the rear panel 36. The flap 37 spans the lower section 28, the first lateral section 23, and the second lateral section 24 in the collapsed state in order to detachably engage with the front panel 33.

Referencing FIG. 1-3 and FIG. 5-7, the front panel 33 comprises a front pocket 34. The front pocket 34 is provided as a means of quickly storing items that would routinely used such as baby wipes. The front pocket 34 is positioned on the front panel 33 opposite the first folding panel 38 and the second folding panel 39. The front pocket 34 additionally comprises a flap coupler 35 that is positioned on the exterior portion of the front pocket 34. The flap coupler 35 is the detachable engagement point that is provided to secure the flap 37 to the front panel 33 in the collapsed state.

Figure 6:
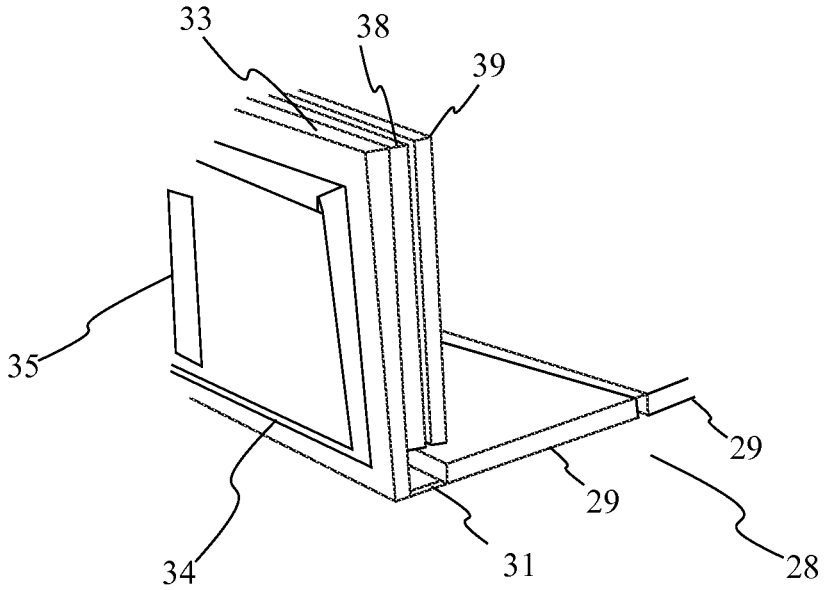
FIG. 6 is an enhanced view displaying the repositioning of the at least one padded folding panels of the lower section as they transition from the assembled state to the collapsed state as per the current embodiment of the present invention.
Figure 6:
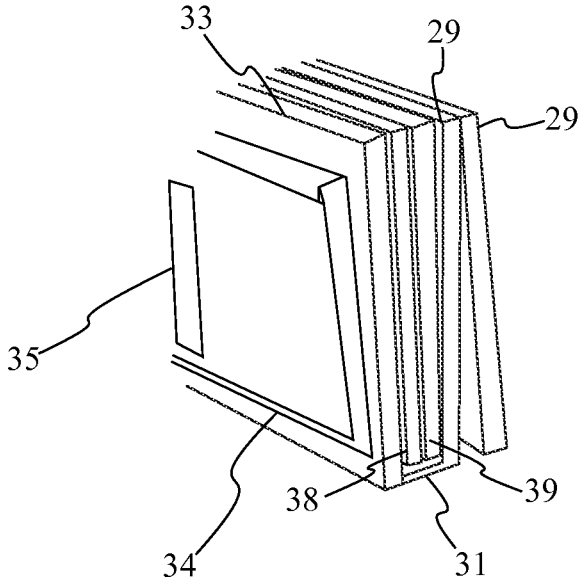
Figure 7:
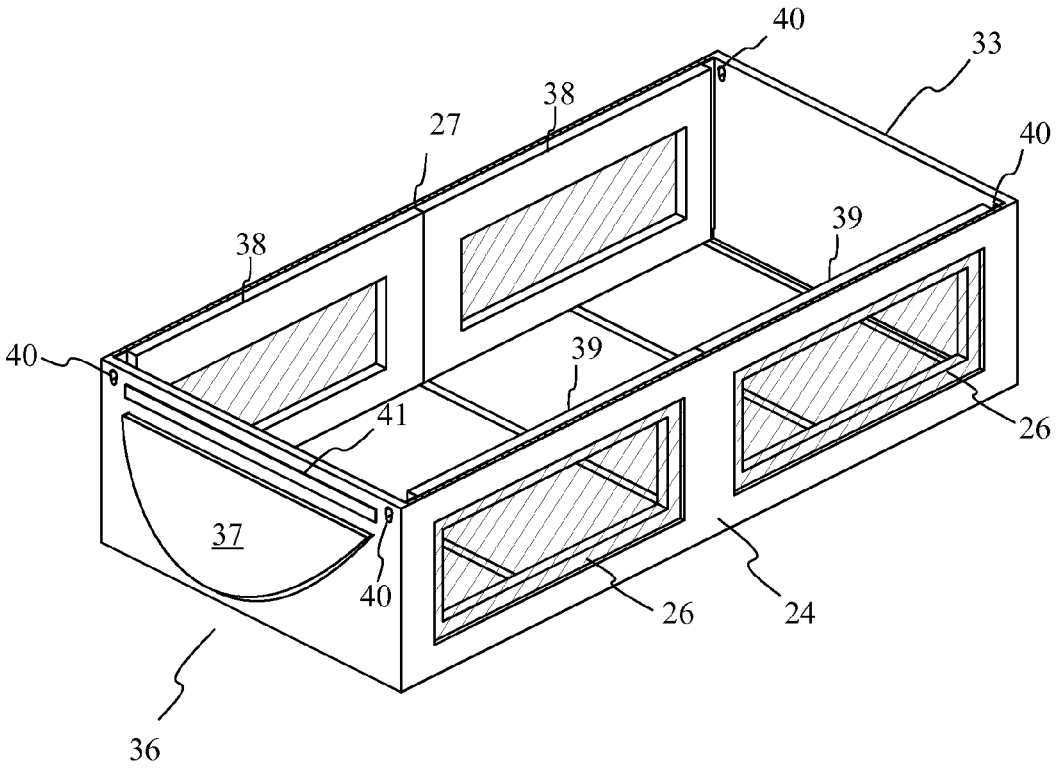
FIG. 7 is a rear perspective view displaying the rear panel of the crib section in the assembled state as per the current embodiment of the present invention.
Figure 8:
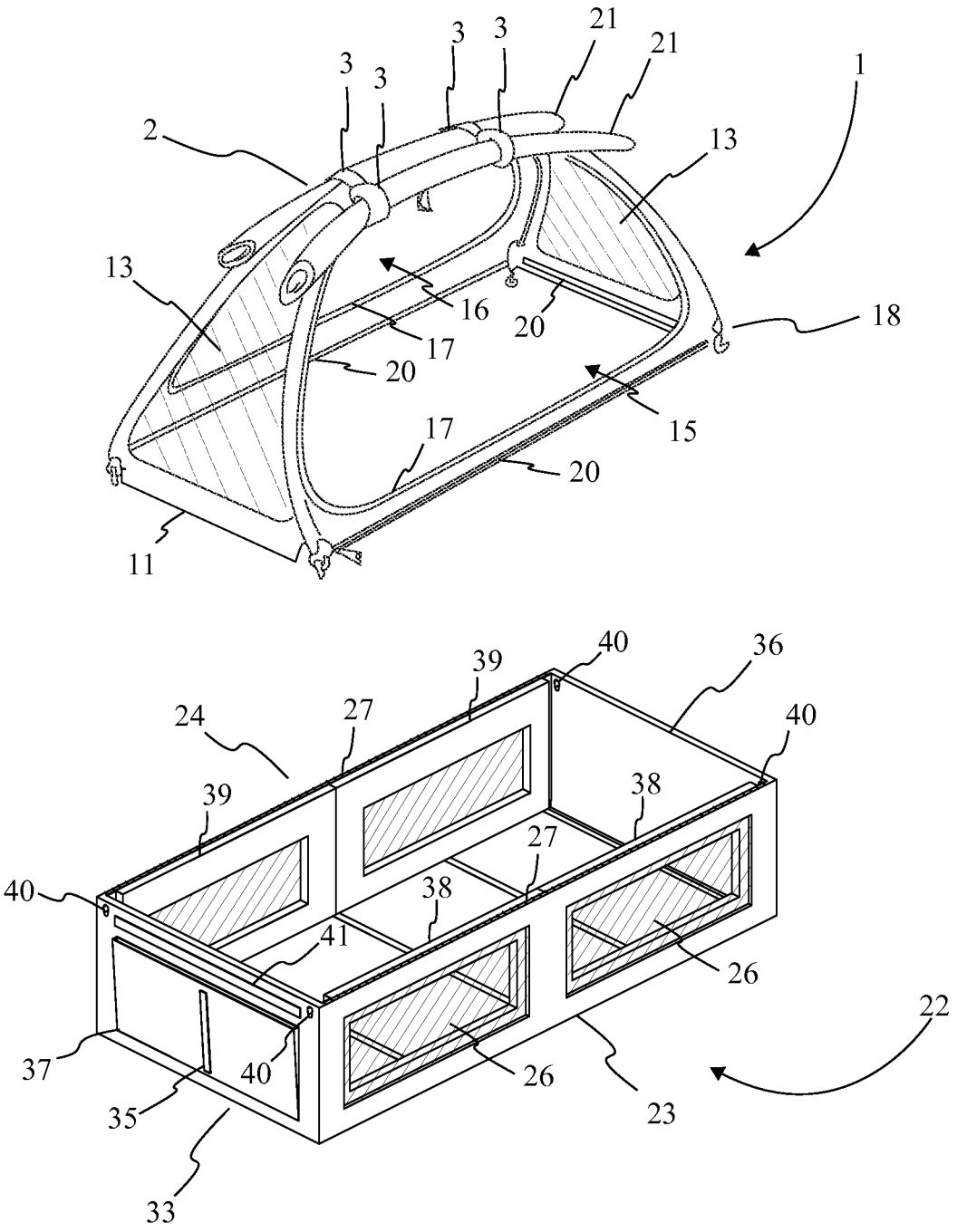
FIG. 8 is a perspective view displaying the canopy doors of the canopy section being temporarily retained by the canopy door ties, as per the current embodiment of the present invention.

Referencing FIG. 3 and FIG. 6, the lower section 28 functions as a padded base that an infant is rested on top of. The lower section 28 is bordered by the front panel 33, the rear panel 36, the first lateral section 23, and the second lateral section 24. The lower section 28 is positioned on the crib section 22 opposite the engagement to the canopy section 1. In the current embodiment of the present invention, the lower section 28 comprises at least one pair of padded folding panels 29, a front panel mount 31, and a rear panel mount 32. The front panel mount 31 and the rear panel mount 32 are provided as recessed portion of the lower section 28 that are positioned between the front panel 33 and the at least one pair of padded folding panels 29, as well as the rear panel 36 and the at least one pair of padded folding panels 29, respectively. The at least one pair of padded folding panels 29 allows the lower section 28 to fold in order to transition between the assembled state and the collapsed state. The at least one pair of padded folding panels 29 are found positioned between the front panel mount 31 and the rear panel mount 32. The at least one pair of padded folding panel comprise a pair of folding panel fasteners. The pair of folding panel fasteners are provided with a particular arrangement that makes them coincident to one another when the at least one pair of padded folding panels 29 are folded in the collapsed state. It should be noted that the at least one pair of padded folding panels 29 comprise a padded section and a rigid section. The padded section is provided as the portion of the at least one pair of padded folding panels 29 that functions as the surface upon which and infant rests upon. The rigid section is positioned below the padded section and functions as a structural element that prevents the at least one padded folding panels 29 form deforming as an infant rolls on top of it.

Referencing FIG. 1-3, FIG. 5-7, and FIG. 13, the at least one adjustable strap 42 is provided as a means of securing the crib section 22 to another surface. The at least one adjustable strap 42 is coupled to the lower section 28. The at least one adjustable strap 42 is adjustable by way of the length of the strap. The adjustable strap 42 comprises a first strap end 43 and a second strap end 44. The first strap end 43 and the second strap end 44 function as complimentary components that secure the at least one adjustable strap 42 to another surface during the assembled state. During the collapsed state the at least one adjustable strap 42 can function as a carrying strap for the crib section 22.

Referencing FIG. 9, in an embodiment of the present invention, the collapsible crib is provided with a floor pad 45. The floor pad 45 functions as a non-enclosed padded surface to position an infant on top of. The floor pad 45 is provided as an alternative to the crib section 22 and can be attached to the canopy section 1 by way of the plurality canopy anchors. In order to accommodate the plurality of canopy anchors 19, the floor pad 45 comprises a plurality of anchor mounts 46. The plurality of anchor mounts 46 allow the canopy section 1 to be detachably coupled to the floor pad 45. The floor pad 45 is flexible in construction and can be rolled up when not in use.

Referencing FIG. 9 and FIG. 12, in an embodiment of the present invention the crib section 22, the canopy section 1, and the floor pad 45 are provided with a storage bag 47 that functions as a means of facilitating the transport of the collapsible crib. The storage bag 47 is particularly shaped to house the various components of the collapsible crib. The crib section 22 in the collapsed state is rectangular in shape. The canopy section 1 in the collapsed state is flat and partly circular in shape, wherein the non circular portions of the canopy section 1 are due to the terminal ends of the first flexible pole 5 and the second flexible pole 6. The floor pad 45 in the collapsed state is rolled into a cylinder. With the canopy section 1, the crib section 22, and the floor pad 45 in the collapsed state, a user would positioning them within the storage bag 47 for transport.

Although the invention has been explained in relation to its preferred embodiment, it is to be understood that many other possible modifications and variations can be made without departing from the spirit and scope of the invention as hereinafter claimed.

What is claimed is:

1. A collapsible crib comprises:

a canopy section;

a crib section;

the canopy section comprises an apex, a first flexible pole, a second flexible pole, a canopy cover, and at least one canopy door;

the crib section comprises a first lateral section, a second lateral section, a lower section, a front panel, a rear panel, and at least one adjustable strap;

the apex comprises at least one canopy door tie and a hanger loop;

the canopy cover comprises a first pole guide, a second pole guide, a front section, a rear section, a first canopy opening, a second canopy opening, and a canopy base section;

the first lateral section and the second lateral section each comprise a pair of panel fasteners, a heavy mesh screen, and a canopy base fastener;

the lower section comprises at least one pair of padded folding panels, a front panel mount, and a rear panel mount;

the front panel and the rear panel each comprise a first folding panel, a second folding panel, a pair of anchor mounts, and a canopy coupler;

the front panel comprises a front pocket;

the rear panel comprises a flap;

the at least one adjustable strap comprises a first strap end and a second strap end;

the first pole guide and the second pole guide each comprise a pair of pole mounts;

the front section and the rear section each comprise a panel coupler and a light mesh screen;

the first canopy opening and the second canopy opening each comprise a canopy door fastener;

the canopy base section comprises a plurality of canopy anchors and lateral section fasteners;

each pair of padded folding panels of the at least one pair of padded folding panels comprise a pair of folding panel fasteners;

the front pocket comprises a flap coupler; and the canopy section being detachably coupled to the crib section.

2. The collapsible crib as claimed in claim 1 comprises:

the first flexible pole being parabolically flexed across the second flexible pole, wherein the second flexible pole is parabolically flexed below the first flexible pole;

the apex being coincident at the intersection of the first flexible pole with the second flexible pole;

the canopy cover being disposed over the first flexible pole and the second flexible pole;

the front panel being positioned opposite the rear panel across the crib section;

the lower section being bordered by the first lateral section, the second lateral section, the front panel, and the rear panel;

the canopy cover being detachably coupled to the crib section opposite the lower section; and the at least two adjustable straps being coupled to the lower section.

3. The collapsible crib as claimed in claim 1 comprises:

the first pole guide being traversed through by the first flexible pole;

the first flexible pole being terminally engaged by the pair of pole mounts of the first pole guide;

the second pole guide being traversed through by the second flexible pole;

the second flexible pole being terminally engaged by the pair of pole mounts of the second pole guide;

the pair of pole mount of the first pole guide and the second pole guide being coincident with the canopy base section;

the canopy base section being coincident with the front section, the rear section;

the front section being detachably coupled with the front panel;

the rear section being detachably coupled with the rear panel;

the canopy base section being positioned between the first lateral section and the first canopy opening;

the canopy base section being positioned between the second lateral section and the second canopy opening;

at least one canopy door being detachably fastened to the canopy door fastener of the first canopy opening;

at least one canopy door being detachably fastened to the canopy door fasteners of the second canopy opening;

the at least one canopy door being partially retained by the at least one canopy door tie; and the hanger loop being positioned below the first flexible pole and the second flexible pole.

4. The collapsible crib as claimed in claim 1 comprise:

lateral section fasteners of the canopy base section being detachably coupled to the canopy base fastener of the first lateral section;

lateral section fasteners of the canopy base section being detachably coupled to the canopy base fastener of the second lateral section;

the panel coupler of the front section being detachably coupled to the front panel;

the panel coupler of the rear section being detachably coupled to the rear panel;

the front pocket being positioned below the panel coupler on the front panel;

the front pocket being found opposite the positioning of the front panel mount;

the at least one pair of padded folding panels being collapsibly positioned between the front panel mount and the rear panel mount;

the at least one pair of padded folding panels being collapsibly secured to one another by way of the pair of folding panel fasteners;

the flap being detachably coupled to the flap coupler, wherein the flap spans from the rear panel to the front panel when the at least one pair of padded folding panels are collapsibly secured to themselves;

both the first lateral section and the second lateral section being collapsibly positioned between the front panel and the rear panel;

the heavy mesh screen of the first lateral section being positioned between the canopy base fasteners and the at least one pair of padded folding panels; and the heavy mesh screen of the second lateral section being positioned between the canopy base fasteners and the at least one pair of padded folding panels.

5. The collapsible crib as claimed in claim 1 comprises:

both the first folding panel and the second folding panel of the front panel being pivotably coincident with the front panel mount;

both the first folding panel and the second folding panel of the rear panel being pivotably coincident with the rear panel mount;

the first folding panel of both the front panel and the rear panel being detachably coupled to the pair of panel fasteners of the first lateral section;

the second folding panel of both the front panel and the rear panel being detachably coupled to the pair of panel fasteners of the second lateral section;

the pair of anchor mounts of the front panel being detachably coupled to the plurality of canopy anchors adjacent to the front section;

the pair of anchor mounts of the rear panel being detachably coupled to the plurality of canopy anchors adjacent to the rear section;

the light mesh screen of the front section being positioned between the panel coupler of the front section and the apex;

the light mesh screen of the rear section being positioned between the panel coupler of the rear section and the apex;

the at least one adjustable strap positioned across the at least one pair of padded folding panels, wherein the at least one adjustable strap spans across from the first lateral section to the second lateral section; and the first strap end being detachably coupled to the second strap end.

6. The collapsible crib as claimed in claim 1 comprises:

a floor pad;

the floor pad comprises a plurality of anchor mounts; and the plurality of anchor mounts being detachably coupled to the plurality of canopy anchors of the canopy base section.

7. The collapsible crib in claim 1 wherein the crib section and the canopy section being retained within a storage bag for facilitated transport.

8. The collapsible crib in claim 1 wherein the crib section, the canopy section, and a floor pad being retained within a storage bag for facilitated transport.

9. A collapsible crib comprises:

a canopy section;

a crib section;

a floor pad;

the canopy section comprises an apex, a first flexible pole, a second flexible pole, a canopy cover, and at least one canopy door;

the crib section comprises a first lateral section, a second lateral section, a lower section, a front panel, a rear panel, and at least one adjustable strap;

the apex comprises at least one canopy door tie and a hanger loop;

the canopy cover comprises a first pole guide, a second pole guide, a front section, a rear section, a first canopy opening, a second canopy opening, and a canopy base section;

the floor pad comprises a plurality of anchor mounts;

the first lateral section and the second lateral section each comprise a pair of panel fasteners, a heavy mesh screen, and a canopy base fastener;

the lower section comprises at least one pair of padded folding panels, a front panel mount, and a rear panel mount;

the front panel and the rear panel each comprise a first folding panel, a second folding panel, a pair of anchor mounts, and a canopy coupler;

the front panel comprises a front pocket;

the rear panel comprises a flap;

the at least one adjustable strap comprises a first strap end and a second strap end;

the first pole guide and the second pole guide each comprise a pair of pole mounts;

the front section and the rear section each comprise a panel coupler and a light mesh screen;

the first canopy opening and the second canopy opening each comprise a canopy door fastener;

the canopy base section comprises a plurality of canopy anchors and lateral section fasteners;

each pair of padded folding panels of the at least one pair of padded folding panels comprise a pair of folding panel fasteners;

the front pocket comprises a flap coupler;

the canopy section being detachably coupled to the crib section;

the first flexible pole being parabolically flexed across the second flexible pole, wherein the second flexible pole is parabolically flexed below the first flexible pole;

the apex being coincident at the intersection of the first flexible pole with the second flexible pole;

the canopy cover being disposed over the first flexible pole and the second flexible pole;

the front panel being positioned opposite the rear panel across the crib section;

the lower section being bordered by the first lateral section, the second lateral section, the front panel, and the rear panel;

the canopy cover being detachably coupled to the crib section opposite the lower section; and the at least two adjustable straps being coupled to the lower section.

10. The collapsible crib as claimed in claim 9 comprises:

the first pole guide being traversed through by the first flexible pole;

the first flexible pole being terminally engaged by the pair of pole mounts of the first pole guide;

the second pole guide being traversed through by the second flexible pole;

the second flexible pole being terminally engaged by the pair of pole mounts of the second pole guide;

the pair of pole mount of the first pole guide and the second pole guide being coincident with the canopy base section;

the canopy base section being coincident with the front section, the rear section;

the front section being detachably coupled with the front panel;

the rear section being detachably coupled with the rear panel;

the canopy base section being positioned between the first lateral section and the first canopy opening;

the canopy base section being positioned between the second lateral section and the second canopy opening;

at least one canopy door being detachably fastened to the canopy door fastener of the first canopy opening;

at least one canopy door being detachably fastened to the canopy door fasteners of the second canopy opening;

the at least one canopy door being partially retained by the at least one canopy door tie;

the hanger loop being positioned below the first flexible pole and the second flexible pole;

lateral section fasteners of the canopy base section being detachably coupled to the canopy base fastener of the first lateral section;

lateral section fasteners of the canopy base section being detachably coupled to the canopy base fastener of the second lateral section;

the panel coupler of the front section being detachably coupled to the front panel;

the panel coupler of the rear section being detachably coupled to the rear panel;

the front pocket being positioned below the panel coupler on the front panel;

the front pocket being found opposite the positioning of the front panel mount;

the at least one pair of padded folding panels being collapsibly positioned between the front panel mount and the rear panel mount;

the at least one pair of padded folding panels being collapsibly secured to one another by way of the pair of folding panel fasteners;

the flap being detachably coupled to the flap coupler, wherein the flap spans from the rear panel to the front panel when the at least one pair of padded folding panels are collapsibly secured to themselves;

both the first lateral section and the second lateral section being collapsibly positioned between the front panel and the rear panel;

the heavy mesh screen of the first lateral section being positioned between the canopy base fasteners and the at least one pair of padded folding panels; and the heavy mesh screen of the second lateral section being positioned between the canopy base fasteners and the at least one pair of padded folding panels.

11. The collapsible crib as claimed in claim 9 comprises:

both the first folding panel and the second folding panel of the front panel being pivotably coincident with the front panel mount;

both the first folding panel and the second folding panel of the rear panel being pivotably coincident with the rear panel mount;

the first folding panel of both the front panel and the rear panel being detachably coupled to the pair of panel fasteners of the first lateral section;

the second folding panel of both the front panel and the rear panel being detachably coupled to the pair of panel fasteners of the second lateral section;

the pair of anchor mounts of the front panel being detachably coupled to the plurality of canopy anchors adjacent to the front section;

the pair of anchor mounts of the rear panel being detachably coupled to the plurality of canopy anchors adjacent to the rear section;

the light mesh screen of the front section being positioned between the panel coupler of the front section and the apex;

the light mesh screen of the rear section being positioned between the panel coupler of the rear section and the apex;

the at least one adjustable strap positioned across the at least one pair of padded folding panels, wherein the at least one adjustable strap spans across from the first lateral section to the second lateral section;

the first strap end being detachably coupled to the second strap end; and the plurality of anchor mounts being detachably coupled to the plurality of canopy anchors of the canopy base section.

12. The collapsible crib in claim 9 wherein the crib section and the canopy section being retained within a storage bag for facilitated transport.

13. The collapsible crib in claim 9 wherein the crib section, the canopy section, and a floor pad being retained within a storage bag for facilitated transport.

14. A collapsible crib comprises:

a canopy section;

a crib section;

a floor pad;

the canopy section comprises an apex, a first flexible pole, a second flexible pole, a canopy cover, and at least one canopy door;

the crib section comprises a first lateral section, a second lateral section, a lower section, a front panel, a rear panel, and at least one adjustable strap;

the apex comprises at least one canopy door tie and a hanger loop;

the canopy cover comprises a first pole guide, a second pole guide, a front section, a rear section, a first canopy opening, a second canopy opening, and a canopy base section;

the floor pad comprises a plurality of anchor mounts;

the first lateral section and the second lateral section each comprise a pair of panel fasteners, a heavy mesh screen, and a canopy base fastener;

the lower section comprises at least one pair of padded folding panels, a front panel mount, and a rear panel mount;

the front panel and the rear panel each comprise a first folding panel, a second folding panel, a pair of anchor mounts, and a canopy coupler;

the front panel comprises a front pocket;

the rear panel comprises a flap;

the at least one adjustable strap comprises a first strap end and a second strap end;

the first pole guide and the second pole guide each comprise a pair of pole mounts;

the front section and the rear section each comprise a panel coupler and a light mesh screen;

the first canopy opening and the second canopy opening each comprise a canopy door fastener;

the canopy base section comprises a plurality of canopy anchors and lateral section fasteners;

each pair of padded folding panels of the at least one pair of padded folding panels comprise a pair of folding panel fasteners;

the front pocket comprises a flap coupler;

the canopy section being detachably coupled to the crib section;

the first flexible pole being parabolically flexed across the second flexible pole, wherein the second flexible pole is parabolically flexed below the first flexible pole;

the apex being coincident at the intersection of the first flexible pole with the second flexible pole;

the canopy cover being disposed over the first flexible pole and the second flexible pole;

the front panel being positioned opposite the rear panel across the crib section;

the lower section being bordered by the first lateral section, the second lateral section, the front panel, and the rear panel;

the canopy cover being detachably coupled to the crib section opposite the lower section;

the at least two adjustable straps being coupled to the lower section;

the first pole guide being traversed through by the first flexible pole;

the first flexible pole being terminally engaged by the pair of pole mounts of the first pole guide;

the second pole guide being traversed through by the second flexible pole;

the second flexible pole being terminally engaged by the pair of pole mounts of the second pole guide;

the pair of pole mount of the first pole guide and the second pole guide being coincident with the canopy base section;

the canopy base section being coincident with the front section, the rear section;

the front section being detachably coupled with the front panel;

the rear section being detachably coupled with the rear panel;

the canopy base section being positioned between the first lateral section and the first canopy opening;

the canopy base section being positioned between the second lateral section and the second canopy opening;

at least one canopy door being detachably fastened to the canopy door fastener of the first canopy opening;

at least one canopy door being detachably fastened to the canopy door fasteners of the second canopy opening;

the at least one canopy door being partially retained by the at least one canopy door tie;

the hanger loop being positioned below the first flexible pole and the second flexible pole;

lateral section fasteners of the canopy base section being detachably coupled to the canopy base fastener of the first lateral section;

lateral section fasteners of the canopy base section being detachably coupled to the canopy base fastener of the second lateral section;

the panel coupler of the front section being detachably coupled to the front panel;

the panel coupler of the rear section being detachably coupled to the rear panel;

the front pocket being positioned below the panel coupler on the front panel;

the front pocket being found opposite the positioning of the front panel mount;

the at least one pair of padded folding panels being collapsibly positioned between the front panel mount and the rear panel mount;

the at least one pair of padded folding panels being collapsibly secured to one another by way of the pair of folding panel fasteners;

the flap being detachably coupled to the flap coupler, wherein the flap spans from the rear panel to the front panel when the at least one pair of padded folding panels are collapsibly secured to themselves;

both the first lateral section and the second lateral section being collapsibly positioned between the front panel and the rear panel;

the heavy mesh screen of the first lateral section being positioned between the canopy base fasteners and the at least one pair of padded folding panels;

the heavy mesh screen of the second lateral section being positioned between the canopy base fasteners and the at least one pair of padded folding panels;

both the first folding panel and the second folding panel of the front panel being pivotably coincident with the front panel mount;

both the first folding panel and the second folding panel of the rear panel being pivotably coincident with the rear panel mount;

the first folding panel of both the front panel and the rear panel being detachably coupled to the pair of panel fasteners of the first lateral section;

the second folding panel of both the front panel and the rear panel being detachably coupled to the pair of panel fasteners of the second lateral section;

the pair of anchor mounts of the front panel being detachably coupled to the plurality of canopy anchors adjacent to the front section;

the pair of anchor mounts of the rear panel being detachably coupled to the plurality of canopy anchors adjacent to the rear section;

the light mesh screen of the front section being positioned between the panel coupler of the front section and the apex;

the light mesh screen of the rear section being positioned between the panel coupler of the rear section and the apex;

the at least one adjustable strap positioned across the at least one pair of padded folding panels, wherein the at least one adjustable strap spans across from the first lateral section to the second lateral section;

the first strap end being detachably coupled to the second strap end; and the plurality of anchor mounts being detachably coupled to the plurality of canopy anchors of the canopy base section.

15. The collapsible crib in claim 14 wherein the crib section and the canopy section being retained within a storage bag for facilitated transport.

16. The collapsible crib in claim 14 wherein the crib section, the canopy section, and a floor pad being retained within a storage bag for facilitated transport.

* * * * *